US006942524B2

(12) United States Patent
Wu

(10) Patent No.: US 6,942,524 B2
(45) Date of Patent: Sep. 13, 2005

(54) HIGH SPEED ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/456,369

(22) Filed: Jun. 6, 2003

(65) Prior Publication Data

US 2004/0248470 A1 Dec. 9, 2004

(51) Int. Cl.[7] ..... H01R 12/16
(52) U.S. Cl. ..... 439/637; 439/62
(58) Field of Search ..... 439/637, 680, 439/701, 59, 62, 65, 629, 630

(56) References Cited

U.S. PATENT DOCUMENTS 5,931,701 A * 8/1999 Pan et al. ..... 439/637
6,036,548 A * 3/2000 Braithwaite ..... 439/637
6,244,902 B1 * 6/2001 McDowell et al. ..... 439/630
6,296,491 B1 * 10/2001 Pickles ..... 439/637
6,331,122 B1 12/2001 Wu
D469,407 S 1/2003 Wu
6,746,281 B1 * 6/2004 Zhang ..... 439/637

* cited by examiner

*Primary Examiner*—Renee Luebke
(74) *Attorney, Agent, or Firm*—Wei Te Chung

(57) ABSTRACT

An electrical connector (1) includes a longitudinal insulative housing (10) and a number of contacts (20). The insulative housing includes a first side wall (13) and a second side wall (14) opposed to the first side wall. The first side wall includes first and second longitudinally arranged thicker portions (131, 132) and a transitional portion (133) having a lateral dimension less than and spacing the first and the second thicker portions. The second side wall includes a third thicker portion. Each of the first, the second and the third thicker portions defines a number of passageways (134) therein. The contacts comprise a number of first, second and third contacts (21, 22, 23) received in the passageways of the first, the second and the third thicker portions, respectively.

20 Claims, 7 Drawing Sheets

HIGH SPEED ELECTRICAL CONNECTOR

BACKGROUND OF THE INVENTION

1. Field of the Invention

The present invention relates to an electrical connector, and more particularly to a high speed Serial Attached SCSI (Small Computer System Interface) (SAS) connector mounted on a printed circuit board (PCB).

2. Description of the Related Art

Parallel ATA (Advanced Technology Attachment) and parallel SCSI are two dominant disk interfaces technologies today. The parallel ATA disks are widely used in desktop PCs and mobile PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not tired to a particular clock speed.

Serial ATA (SATA) is a serial version of ATA, which is expected to be a replacement for parallel ATA. U.S. Pat. No. 6,331,122 discloses a type of SATA receptacle connector for being mounted on a Printed Circuit Board. The receptacle connector has two receiving cavities defined in an insulative housing thereof and two sets of conductive contacts respectively used for power and signal transmission installed in the insulative housing. U.S. Pat. No. D469,407 discloses an electrical connector assembly with a SATA plug connector as a part thereof. The plug connector has two generally L-shaped tongue plates receiving two sets of terminals for electrically connecting the conductive contacts as the tongue plates are inserted into the respective receiving cavities of the receptacle connector.

Serial Attached SCSI (SAS) is a successor to the parallel SCSI and is also based on serial technology. Besides the advantage of higher speed signal transmission, another most significant advantage is the SAS interface will also be compatible with SATA drives. In other words, the SATA plug connector can plug directly into an SAS receptacle connector if supported in the system. By this way, the system builders are flexible to integrate either SAS or SATA devices and slash the costs associated with supporting two separate interfaces.

The SAS receptacle connector has generally the same configuration as the SATA receptacle connector except that the two cavities of the SATA receptacle connector are merged in a large one of the SAS receptacle connector, and a third sets of signal contacts are assembled to a second side wall opposing a first side wall where two sets of contacts have already being assembled. However, the second side wall is much thinner in a lateral direction of the connector than the first side wall. Thus, it is difficult to provide passageways in such second side wall like in the first side wall for receiving contacts and allowing the contact portion of each to be moveable therein. If the third sets of contacts are directly adhered on an inner face of the second side wall with each contact portion curved away from the inner face, when an SAS plug connector mates with the SAS receptacle connector, terminals of the SAS plug connector tightly abut against the corresponding contacts of the SAS receptacle connector to establish an electrical connection therebetween. However, the contact portion of each contact is inevitably deformed toward the inner face after a long term pressure of the terminal, which will reduce the normal contacting force between the contact and the terminal, thereby causing the electrical connection therebetween unreliable or even break.

Hence, an improved electrical connector is required to overcome the disadvantages of the prior art.

SUMMARY OF THE INVENTION

A major object of the present invention is to provide an electrical connector, which can provide a reliable electrical connection with a complementary connector.

In order to achieve the object set forth, an electrical connector comprises a longitudinal insulative housing and a plurality of contacts. The insulative housing comprises a first side wall and a second side wall opposed to the first side wall. The first side wall comprises a first and a second longitudinally arranged thicker portions and a transitional portion having a lateral dimension less than and spacing the first and the second thicker portions. The second side wall comprises a third thicker portion. Each of the first, the second and the third thicker portions defines a plurality of passageways therein. The contacts comprise a plurality of first, second and third contacts received in the passageways of the first, the second and the third thicker portions, respectively.

Other objects, advantages and novel features of the invention will become more apparent from the following detailed description when taken in conjunction with the accompanying drawings.

BRIEF DESCRIPTION OF THE DRAWINGS

FIG. 2 is an exploded, perspective view of the electrical connector of

DETAILED DESCRIPTION OF THE INVENTION

Referring to FIGS. 1 to 4, an electrical connector 1 of the present invention comprises a longitudinal insulative housing 10, a plurality of contacts 20 received in the insulative housing 10 and a pair of board locks 30 attached to opposite ends of the insulative housing 10.

Figure 1:
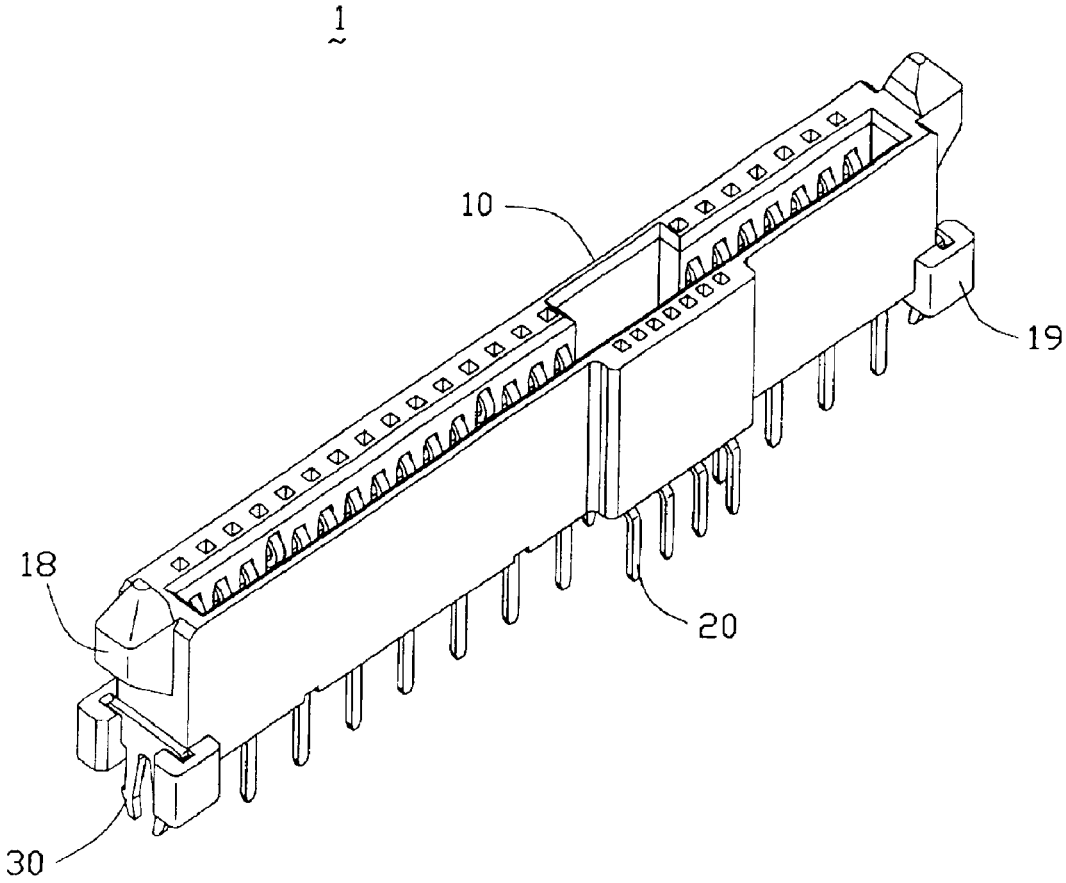
FIG. 1 is a perspective view of an electrical connector in accordance with the present invention.
Figure 2:
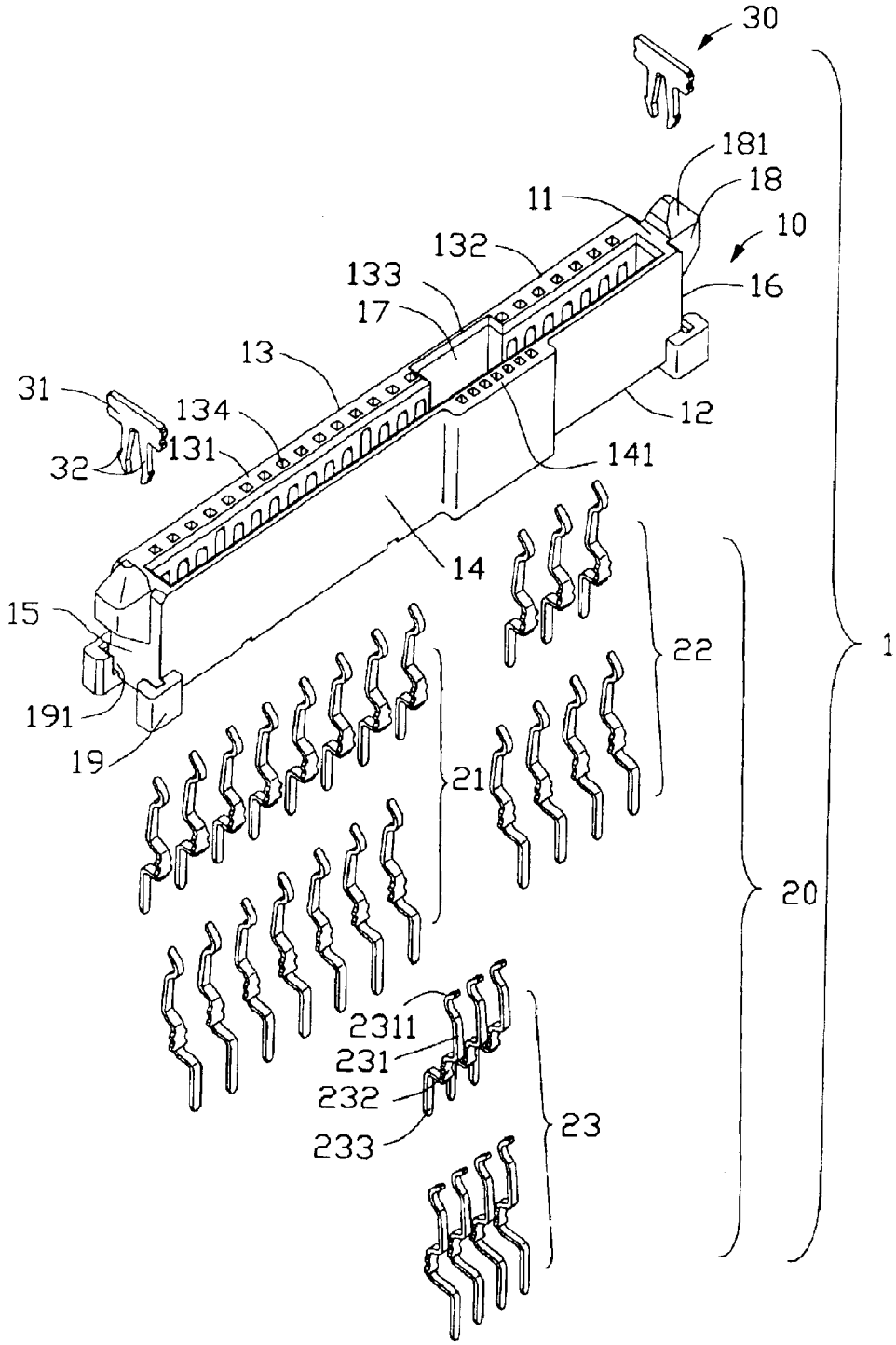
Figure 3:
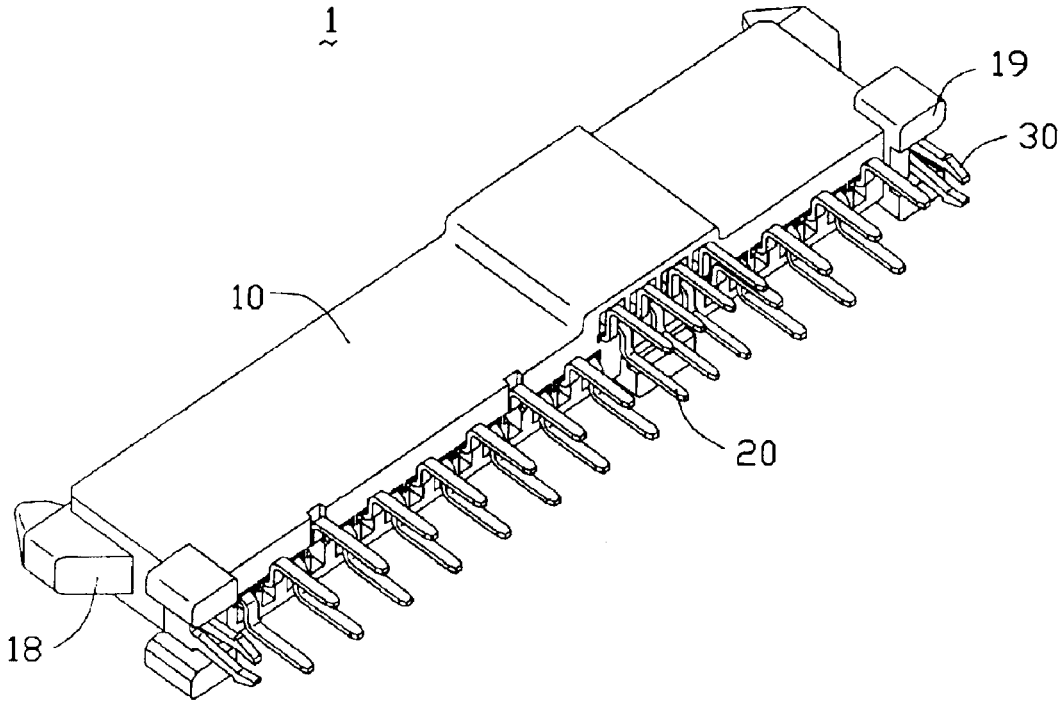
FIG. 3 is a perspective view of the electrical connector of FIG. 1 taken from another aspect.
Figure 4:
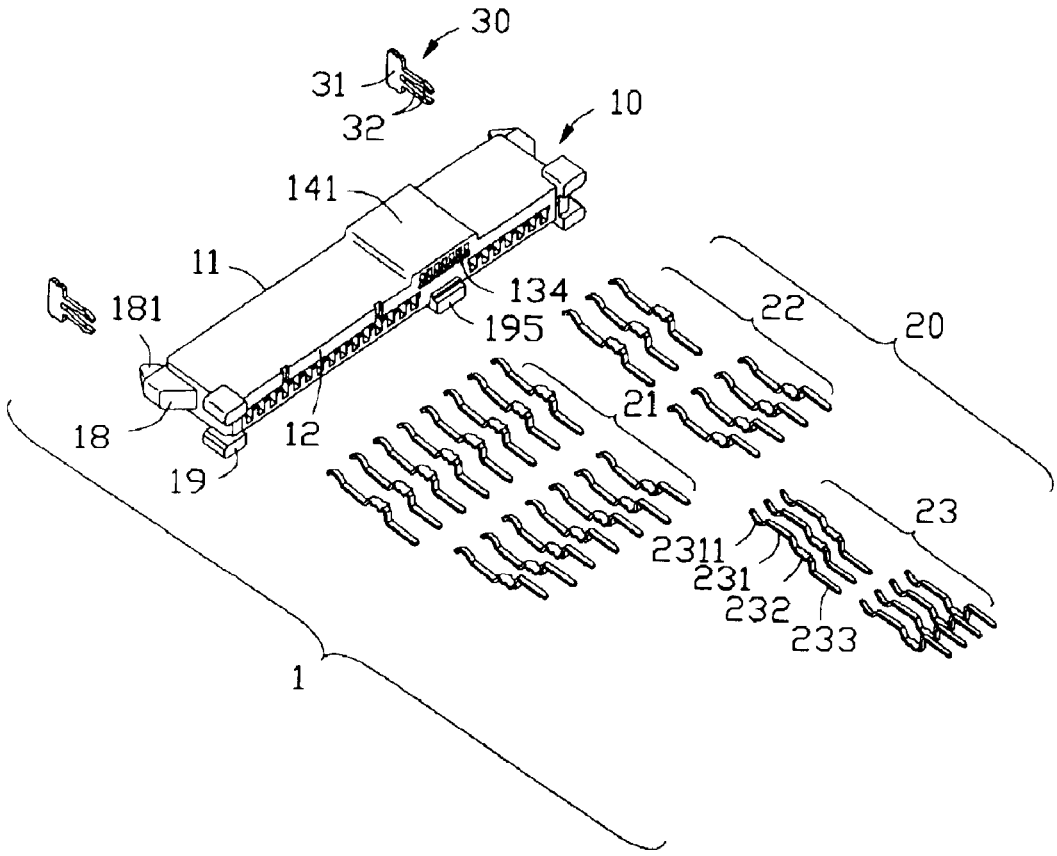
FIG. 4 is an exploded, perspective view of the electrical connector of FIG. 3.
Figure 5:
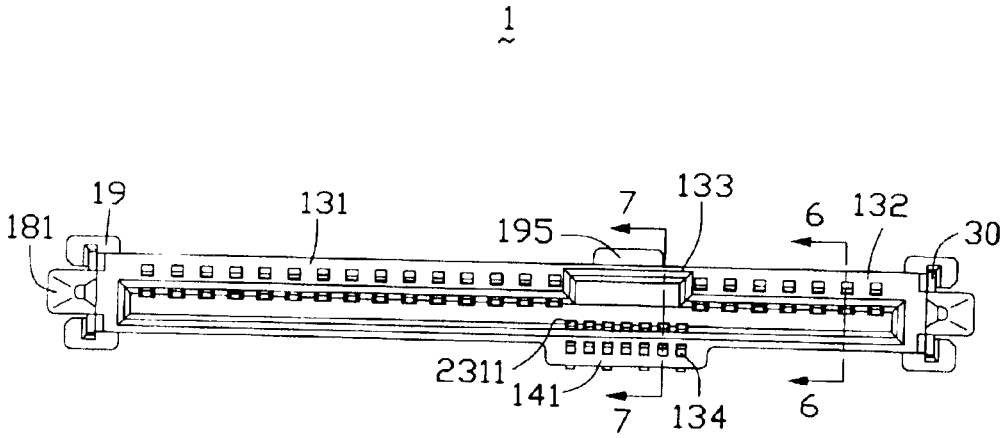
FIG. 5 is a top view of the electrical connector of FIG. 1.
Figure 6:
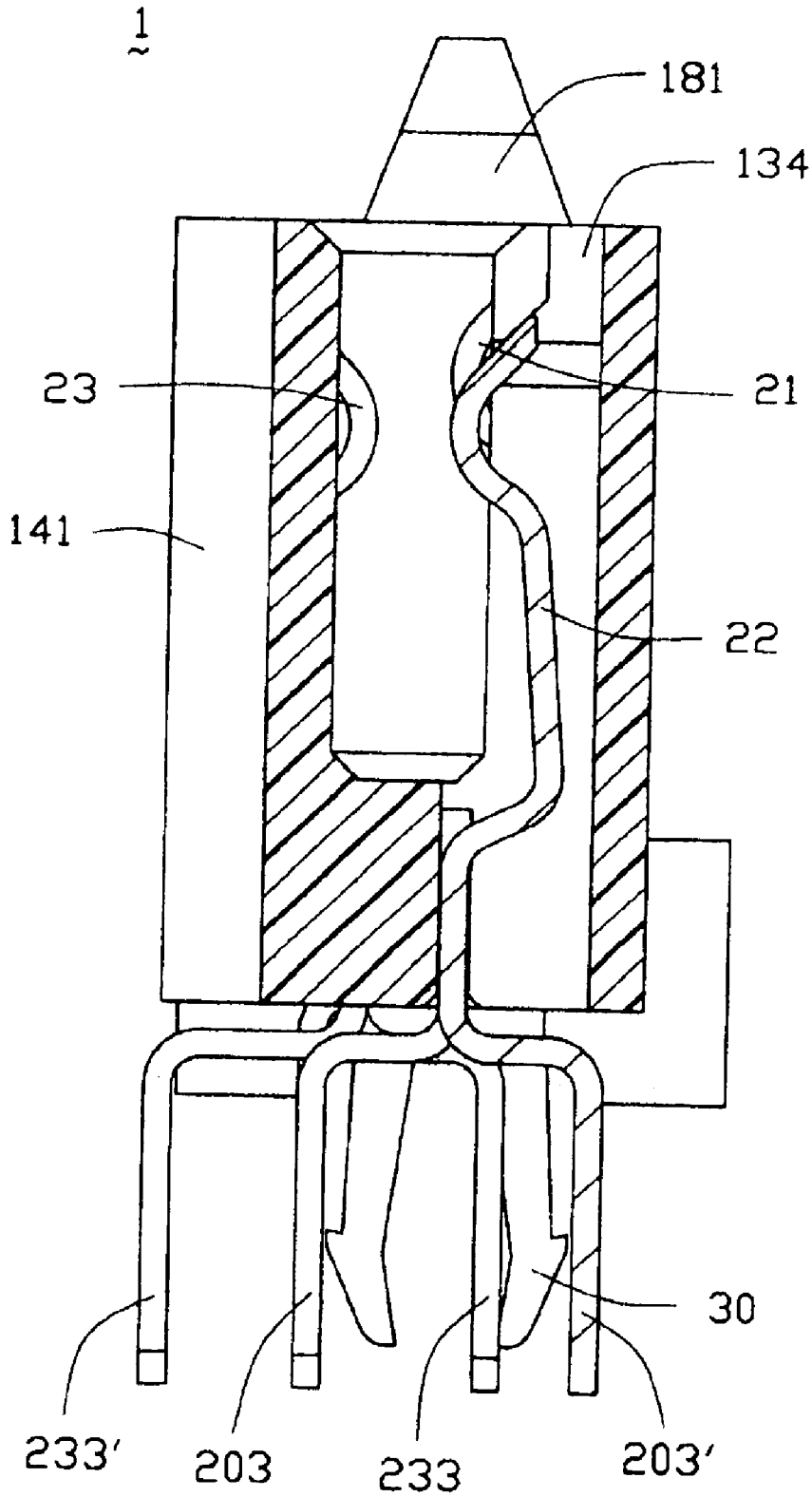
FIG. 6 is a cross-sectional view taken along line 6—6 of FIG. 5.

The insulative housing 10 comprises a mating surface 11, an opposite mounting surface 12, a first and a second opposite longitudinally extending side walls 13, 14, and opposite laterally extending end walls 15, 16. The side and the end walls 13, 14, 15, 16 together define a receiving cavity 17 therebetween for receiving a complementary connector (not shown). The first side wall 13 has a first and a second thicker portions 131, 132 both thickening toward the receiving cavity 17. Each of the first and the second thicker portions 131, 132 is thicker in a lateral direction than and is spaced from each other by a transitional portion 133 located therebetween. The first thicker portion 131 has a longitudinal dimension larger than the second thicker portion 132. The second side wall 14 has a third thicker/expanded portion 141 which thickens away from the receiving cavity 17 and is thicker in a lateral direction than the other portion thereof. The third thicker portion 141 is located at a position substantially opposing to the transitional portion 133 of the first side wall 13 (as best shown in FIG. 5). The first, second and third thicker portions 131, 132, 141 each defines a plurality of passageways 134 therein extending from the mating surface 11 to the mounting face 12 and communicating with the receiving cavity 17 (in conjunction with FIGS. 6 and 7).

The insulative housing 10 includes a pair of guiding blocks 18 outwardly protruding from respective end walls 15, 16 in the longitudinal direction. The guiding blocks 18 are located adjacent to the mating surface 11 and each has a sharp section 181 upwardly extending beyond the mating surface 20 for guidance of the connector 1 to mate with the complementary connector. The insulative housing 10 provides a pair of retention portions 19 at respective corners thereof adjacent the mounting surface 12. Each retention portion 19 downwardly extends beyond the mounting surface 12 to provide stand-off function. Each retention portion 19 and the respective end wall 15 (16) together define a groove 191 where the corresponding board lock 30 is received. The insulative housing 10 further provides a supporting means 195 generally located at a middle section thereof for supporting the connector 1 while it mates with the complementary connector.

The contacts 20 include a set of first contacts 21 mainly for power transmission, a set of second contacts 22 and a set of third contacts 23 both for signal transmission. The first, second and third contacts are respectively held in the passageways 134 of the first, second and third thicker portions 131, 132, 141 of the insulative housing 10. The three sets of contacts 20 are substantially identical in structure, for simplicity, here only the third contacts 23 are discussed. In conjunction with FIGS. 6 and 7, each third contact 23 includes a retaining section 232, a mating section 231 offsetting from the retaining section 232 and then extending upwardly, and a tail section 233, 233' offsetting from the retaining section 232 and extending downwardly. Each retaining section 232 is formed with a plurality of barbs on a pair of sides thereof for interference fitting in the corresponding passageways 134. Each mating section 231 is provided with a curved contacting portion 2311 at a free end thereof exposed in the receiving cavity 17. Each tail section 233, 233' extends beyond the mounting surface 12 of the insulative housing 10 for electrical connecting to a printed circuit board (not shown).

From a side view, the tail sections 233, 233' of the third contacts 23 are arranged in an inner row and an outer row relative to the side wall 14. Similarly, the tail sections 203, 203' of the first and second contacts 21, 22 are also arranged in an inner row and an outer row relative to the side wall 13. In a transverse direction, the inner row tail sections 203 are closer to the outer row tail sections 233' than the inner row tail section 233; the inner row tail sections 233 are closer to the outer row tail sections 203' than the inner row tail sections 203. Thus, the electrical connector 1 with a low profile can accommodate more contacts 20.

The board lock 30 is in the form of a plate body. Each board lock 30 includes a main portion 31 fittingly received in the groove 191 of the respective retention portion 19, and a pair of leg portions 32 extending downwardly from a bottom end of the main portion 31 and each having a barb proximate a distal end thereof for securing the connector 1 on the PCB.

Figure 7:
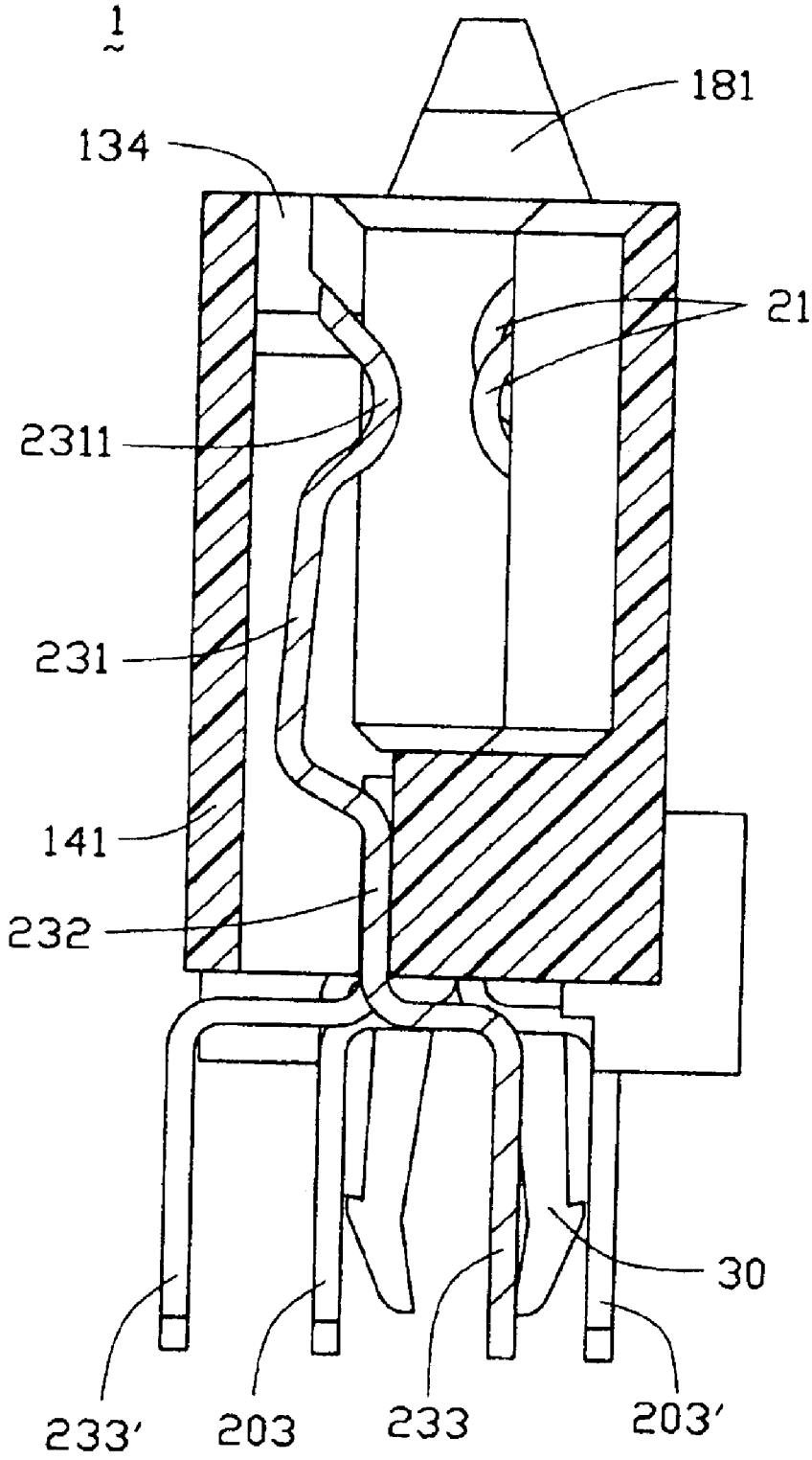
FIG. 7 is a cross-sectional view taken along line 7—7 of FIG. 5.

Referring to FIG. 7, it is important to note that the second side wall 14 has a third thicker portion 141 with a plurality of passageways defined therein, and each passageway 134 of the third thicker portion 141 has a lateral dimension large enough to allow the contacting portion 2311 of the respective third contact 23 to move freely in the passageway with no deformation while pressure of a portion of the complementary connector is added to it, whereby a continuous and constant contacting force is formed between the contacting portion of the third contact and the portion of the complementary connector to establish a reliable electrical connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a longitudinal insulative housing comprising a first side wall and a second side wall opposed to the first side wall, the first side wall comprising first and second longitudinally arranged portions and a transitional portion spacing the first and the second portions, the second side wall comprising an expanded portion, the first and the second portions being thicker in a lateral direction than the transitional portion, the first and the second portions and the expanded portion each defining a plurality of passageways therein; and a plurality of first, second and third contacts received in the passageways of the first, the second and the expanded portions, respectively.

2. The electrical connector as claimed in claim 1, wherein the insulative housing defines a receiving cavity between the first and the second side walls.

3. The electrical connector as claimed in claim 2, wherein each of the first, the second and the third contacts comprises a curved contacting portion exposed in the receiving cavity and laterally movable in the corresponding passageway.

4. The electrical connector as claimed in claim 2, wherein the first and the second portions both thicken toward the receiving cavity, and wherein the expanded portion thickens away from the receiving cavity.

5. The electrical connector as claimed in claim 1, wherein the expanded portion is thicker in a lateral direction than other portions of the second side wall.

6. The electrical connector as claimed in claim 5, wherein the expanded portion is generally located at a position opposed to the transitional portion.

7. The electrical connector as claimed in claim 1, wherein the first portion has a longitudinal dimension larger than that of the second portion.

8. The electrical connector as claimed in claim 1, wherein the first contacts are mainly used for power transmission, and wherein the second and the third contacts are both used for signal transmission.

9. The electrical connector as claimed in claim 1, wherein the insulative housing comprises a guiding block formed at a longitudinal end thereof for guiding a complementary connector.

10. The electrical connector as claimed in claim 1, further comprising a board lock attached to the insulative housing and adapted for securing the connector to a printed circuit board.

11. The electrical connector as claimed in claim 10, wherein the insulative housing comprises a retention portion defining a groove therein for fittingly receiving the board lock.

12. An electrical connector comprising:

a unitary longitudinal insulative housing defining an uninterrupted central slot along a lengthwise direction thereof, the central slot defining a middle portion in said lengthwise direction, said housing including opposite first and second lengthwise walls located at two elongated sides of said central slot, said first wall being thicker than the second wall in a transverse direction perpendicular to said lengthwise direction;

a cavity recessed from an inner face of the first wall and in communication with the middle portion of the central slot along said transverse direction; and an expanded portion integrally formed on an exterior face of the second wall and in alignment with the cavity in said transverse direction.

13. The connector as claimed in claim 12, wherein a plurality of terminals are disposed in the first wall along the lengthwise direction except in the cavity, while no terminals are located in the second wall except in the expanded portion.

14. An electrical connector comprising:

a unitary longitudinal insulative housing defining an uninterrupted central slot along a lengthwise direction thereof, said central slot defining a middle portion in said lengthwise direction, said housing including opposite first and second lengthwise walls located at two elongated sides of said central slot;

a cavity recessed from an inner face of the first wall and in communication with the middle portion of the central slot in a transverse direction perpendicular to said lengthwise direction; and the second wall further including an expanded portion integrally transversely outwardly extending therefrom and in alignment with the cavity in said transverse direction; wherein an exterior face of the first wall and that of the second wall are substantially asymmetrically located at said two elongated sides of the central slot except for the expanded portion.

15. The connector as claimed in claim 14, wherein a plurality of terminals are disposed in the first wall along said lengthwise direction except for the recess.

16. The connector as claimed in claim 14, wherein terminals are disposed in the expanded portion while other portions of the second wall receive no terminals.

17. An electrical connector comprising:

a unitary longitudinal insulative housing defining an uninterrupted central slot extending essentially almost a full length of the housing in a lengthwise direction thereof, said housing including opposite first and second lengthwise walls located at two elongated sides of said central slot, said first wall being thicker than the second wall in a transverse direction perpendicular to said lengthwise direction;

a cavity recessed from an inner face of the first wall and in communication with the central slot along said transverse direction; and an expanded portion integrally formed on an exterior face of the second wall and in alignment with the cavity in said transverse direction; wherein said expanded portion extends upward and terminates at a mating surface of the housing; wherein terminals are disposed in the expanded portion while other portions of the second wall receive no terminals.

18. The connector as claimed in claim 17, wherein a plurality of terminals are disposed in the first wall along the lengthwise direction except in the cavity.

19. An electrical connector comprising:

a unitary longitudinal insulative housing defining an uninterrupted central slot along a lengthwise direction thereof, said housing including opposite first and second lengthwise walls located at two elongated sides of said central slot, said first wall being thicker than the second wall in a transverse direction perpendicular to said lengthwise direction;

a cavity recessed from an inner face of the first wall and in communication with the central slot along said transverse direction; and an expanded portion integrally formed on an exterior face of the second wall and in alignment with the cavity in said transverse direction; wherein a plurality of terminals are disposed in the expanded portion while no terminals are disposed in the remainder of the second wall.

20. The connector as claimed in claim 19, wherein a plurality of terminals are disposed in the first wall except in the cavity.

* * * * *